US008709174B2

(12) United States Patent
Arai et al.

(10) Patent No.: US 8,709,174 B2
(45) Date of Patent: Apr. 29, 2014

(54) SEAMLESS STEEL PIPE FOR LINE PIPE AND METHOD FOR MANUFACTURING THE SAME

(75) Inventors: Yuji Arai, Amagasaki (JP); Keisuke Hitoshio, Hannan (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/609,837

(22) Filed: Sep. 11, 2012

(65) Prior Publication Data

US 2013/0000790 A1 Jan. 3, 2013

Related U.S. Application Data

(63) Continuation of application No. PCT/JP2011/061769, filed on May 23, 2011.

(30) Foreign Application Priority Data

Jun. 2, 2010 (JP) ..... 2010-127307

(51) Int. Cl.

| | |
|---|---|
| ***C22C 38/00*** | (2006.01) |
| ***C21D 11/00*** | (2006.01) |
| ***C21D 9/08*** | (2006.01) |
| ***C22C 38/12*** | (2006.01) |

(52) U.S. Cl.
USPC ..... 148/320; 148/506; 148/593; 420/127

(58) Field of Classification Search
USPC ..... 148/320, 332, 333, 336, 337, 506, 593; 420/127
See application file for complete search history.

(56) References Cited

U.S. PATENT DOCUMENTS

2008/0216928 A1* 9/2008 Kobayashi et al. ..... 148/593

FOREIGN PATENT DOCUMENTS

| | | |
|---|---|---|
| EP | 1 918 397 | 5/2008 |
| JP | 09-059719 | 3/1997 |
| JP | 09-235617 | 9/1997 |
| JP | 2000-104117 | 4/2000 |
| JP | 2000-169913 | 6/2000 |
| JP | 2003-096534 | 4/2003 |
| JP | 2004-124158 | 4/2004 |
| JP | 2006-274350 | 10/2006 |

OTHER PUBLICATIONS

Guthrie et al., "Steel Processing Technology-Processing of Solid Steel", ASM Handbook, 1990, ASM International, vol. 1, p. 1-13.*
Sinha, A.K., "Defects and Distortion in Heat-Treated Parts-Distortion in Heat Treatment", ASM Handbook, 1991, ASM International, vol. 4, p. 1-11.*
Sheng-Xin et al., "Effect of . . . oil-well tubes", Materials Science and Engineering A 485, (2008) 492-499.

* cited by examiner

*Primary Examiner* — Roy King
*Assistant Examiner* — Caitlin Kiechle
(74) *Attorney, Agent, or Firm* — Clark & Brody

(57) ABSTRACT

A seamless steel pipe for line pipe having high strength and high toughness contains, by mass percent, C: 0.02 to 0.10%, Si: at most 0.5%, Mn: 0.5 to 2.0%, Al: 0.01 to 0.1%, P: at most 0.03%, S: at most 0.005%, Ca: at most 0.005%, and N: at most 0.007%, and further contains at least one selected from a group consisting of Ti: at most 0.008%, V: less than 0.06%, and Nb: at most 0.05%, the balance being Fe and impurities. A carbon equivalent Ceq defined by Formula (1) is at least 0.38, a content of Ti, V and Nb satisfies Formula (2), and the size of carbo-nitride containing at least one of Ti, V, Nb and Al is at most 200 nm, $$Ceq=C+Mn/6+(Cr+Mo+V)/5+(Ni+Cu)/15 \quad (1)$$

$$Ti+V+Nb<0.06 \quad (2).$$

8 Claims, 6 Drawing Sheets

(UNIT OF NUMERICAL VALUE:mm)

SEAMLESS STEEL PIPE FOR LINE PIPE AND METHOD FOR MANUFACTURING THE SAME

TECHNICAL FIELD

The present invention relates to a seamless steel pipe and a method for manufacturing the same and, more specifically, to a seamless steel pipe for line pipe and a method for manufacturing the same.

BACKGROUND ART

A pipeline laid on the bottom of the sea allows a high-pressure fluid to flow therein. The pipeline is further subjected to repeated distortion caused by waves and subjected to a seawater pressure. Therefore, a steel pipe used for the pipeline on the bottom of the sea is required to have high strength and high toughness.

In recent years, oil wells and gas wells in a sour environment, especially in the deep sea or in cold climates, severer than the conventional environment is under development. The undersea pipeline laid in such a severe sour environment is required to have strength (pressure resistance) and toughness higher than the conventional ones.

For the undersea pipeline, which is required to have such properties, a seamless steel pipe is more suitable than a welded steel pipe. This is because the welded steel pipe has a weld zone (seam portion) along the longitudinal direction. The weld zone has a toughness lower than that of a base material. Therefore, the seamless steel pipe is suitable for the undersea pipeline.

A thicker wall of the seamless steel pipe provides high strength. However, the increase in wall thickness easily causes a brittle fracture and decreases the toughness. Therefore, the thick-wall seamless steel pipe is required to have excellent toughness. In order to improve the strength and toughness for the thick-wall seamless steel pipe, it is only necessary to increase the content of alloying elements such as carbon to enhance the hardenability. However, in the case where the seamless steel pipes having improved hardenability are joined to each other by circumferential welding, the heat affected zone is liable to harden, and the toughness of the weld zone formed by circumferential welding decreases. For the thick-wall seamless steel pipe used for the undersea pipeline, the base material and weld zone thereof are required to have excellent toughness.

JP2000-104117A (Patent Document 1), JP2000-169913A (Patent Document 2), JP2004-124158A (Patent Document 3), and JP9-235617A (Patent Document 4) propose methods for manufacturing a seamless steel pipe for line pipe, for improving the toughness thereof.

DISCLOSURE OF THE INVENTION

However, in the manufacturing methods disclosed in Patent Documents 1 to 3, a seamless steel pipe having a wall thickness of at most 32 mm is manufactured. Therefore, in the case where a seamless steel pipe having a wall thickness larger than 32 mm is manufactured by any of the manufacturing methods disclosed in Patent Documents 1 to 3, the seamless steel pipe may have low toughness.

In the manufacturing method disclosed in Patent Document 4, a hot rolled seamless steel pipe is heated in a heating furnace, and thereafter is directly quenched and tempered. In the case where the manufacturing method disclosed in Patent Document 4 is used, however, excellent toughness may not be obtained in the thick-wall seamless steel pipe.

An objective of the present invention is to provide a seamless steel pipe for line pipe having high strength and high toughness.

A seamless steel pipe for line pipe according to the present invention has a chemical composition containing, by mass percent, C: 0.02 to 0.10%, Si: at most 0.5%, Mn: 0.5 to 2.0%, Al: 0.01 to 0.1%, P: at most 0.03%, S: at most 0.005%, Ca: at most 0.005%, and N: at most 0.007%, and further contains one or more selected from a group consisting of Ti: at most 0.008%, V: less than 0.06%, and Nb: at most 0.05%, the balance being Fe and impurities. For the seamless steel pipe for line pipe, the carbon equivalent Ceq defined by Formula (1) is at least 0.38, content of Ti, V and Nb in the chemical composition satisfies Formula (2), and the size of carbonitride containing one or more of Ti, V, Nb and Al is at most 200 nm.

$$Ceq=C+Mn/6+(Cr+Mo+V)/5+(Ni+Cu)/15 \quad (1)$$

$$Ti+V+Nb<0.06 \quad (2)$$

where, into each of the symbols of elements in Formulas (1) and (2), the content (mass percent) of each element is substituted. In the case where an element corresponding to the symbol of element in Formulas (1) and (2) is not contained, "0" is substituted into the corresponding symbol of the element in Formulas (1) and (2).

The seamless steel pipe according to the present invention has excellent strength and toughness.

The chemical composition of the above-described seamless steel pipe may contain one or more selected from a group consisting of Cu: at most 1.0%, Cr: at most 1.0%, Ni: at most 1.0%, and Mo: at most 1.0% in place of some of Fe.

The above-described seamless steel pipe is manufactured by being hot worked, thereafter being acceleratedly cooled at a cooling rate of at least 100° C./min, and further being quenched and tempered.

After being acceleratedly cooled, the above-described seamless steel pipe is heated to at least the $A_{c3}$ point and quenched. In heating at the quenching time, the heating rate at the time when the temperature of seamless steel pipe is 600° C. to 900° C. is at least 3° C./min.

The method for manufacturing a seamless steel pipe for line pipe according to the present invention includes the steps of heating a steel material having a chemical composition containing, by mass percent, C: 0.02 to 0.10%, Si: at most 0.5%, Mn: 0.5 to 2.0%, Al: 0.01 to 0.1%, P: at most 0.03%, S: at most 0.005%, Ca: at most 0.005%, and N: at most 0.007%, and further containing one or more selected from a group consisting of Ti: at most 0.008%, V: less than 0.06%, and Nb: at most 0.05%, the balance being Fe and impurities, wherein the carbon equivalent Ceq defined by Formula (1) is at least 0.38, and content of Ti, V and Nb satisfies Formula (2); producing a hollow shell by piercing the heated steel material; producing a seamless steel pipe by rolling the hollow shell; acceleratedly cooling the rolled seamless steel pipe to at most the $A_{r1}$ point at a cooling rate of at least 100° C./min; quenching the acceleratedly-cooled seamless steel pipe after temperature of the seamless steel pipe reaches at least the $A_{c3}$ point by heating it at a heating rate of at least 3° C./min at the time when the temperature of seamless steel pipe is 600 to 900° C.; and tempering the quenched seamless steel pipe at a temperature of at most the $A_{c1}$ point.

In the above-described manufacturing method, the chemical composition of the steel material contains one or more selected from a group consisting of Cu: at most 1.0%, Cr: at most 1.0%, Ni: at most 1.0%, and Mo: at most 1.0% in place of some of Fe.

BEST MODE FOR CARRYING OUT THE INVENTION

Figure 1:
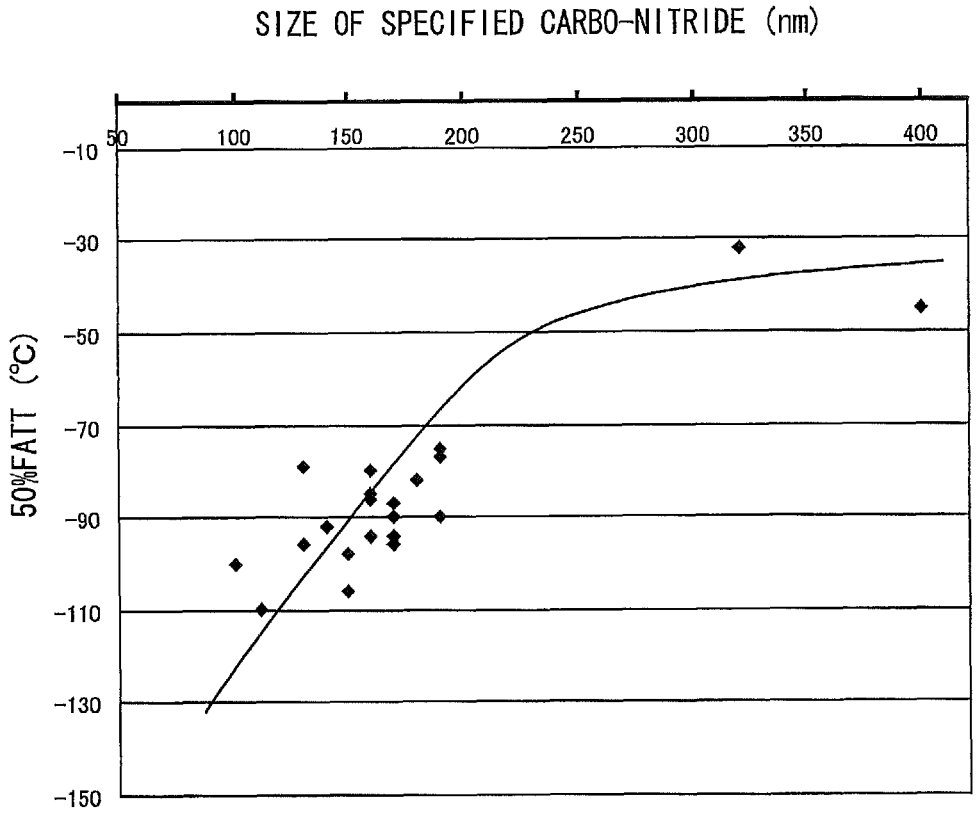
FIG. 1 is a graph showing the relationship between the size of carbo-nitride containing one or more of Ti, V, Nb and Al and the fracture appearance transition temperature (50% FATT) for a seamless steel pipe for line pipe according to an embodiment of the present invention.

An embodiment of the present invention will now be described in detail with reference to the accompanying drawings. In the drawings, the same symbols are applied to the same or equivalent portions, and the explanation thereof is not repeated. Hereunder, an ideogram of % relating to an alloying element denotes a mass percent.

The present inventors completed the invention of the seamless steel pipe for line pipe according to this embodiment based on the following findings:

(A) The carbon content is 0.02 to 0.10%. Further, the carbon equivalent (Ceq) defined by Formula (1) is at least 0.38. Thereby, high strength can be obtained, and the toughness of the weld zone formed by circumferential welding can be restrained from decreasing.

$$Ceq=C+Mn/6+(Cr+Mo+V)/5+(Ni+Cu)/15 \quad (1)$$

(B) A plurality of carbo-nitrides each containing one or more of Ti, V, Nb and Al and having a size of at most 200 nm are refined and dispersed in the steel, whereby the toughness of the seamless steel pipe is improved. The "carbo-nitride" as used herein is a general term of carbide, nitride, and a composite of carbide and nitride. Therefore, the "carbo-nitride" as used herein may be a carbide, a nitride, or a composite of carbide and nitride. Hereunder, the carbo-nitride containing one or more of Ti, V, Nb and Al is called a "specified carbo-nitride".

(C) In order to obtain the size of the specified carbo-nitride at most 200 nm, the content of Ti, V and Nb satisfies Formula (2).

$$Ti+V+Nb<0.06 \quad (2)$$

(D) A seamless steel pipe is manufactured by hot working a round billet having a chemical composition satisfying the above items (A) and (C). The hot-worked seamless steel pipe is acceleratedly cooled. After being acceleratedly cooled, the seamless steel pipe is further quenched and tempered. Specifically, a process of quenching is provided between a process of water cooling (accelerated cooling) the seamless steel pipe produced by using a piercer and a continuous mill (a mandrel mill and a sizer or a stretch reducer) and a process of tempering. In this manufacturing method, fine specified carbo-nitrides having size of at most 200 nm are dispersedly precipitated, so that the toughness of steel is improved.

Hereunder, the details of the seamless steel pipe for line pipe according to this embodiment are explained.

Chemical Composition

The chemical composition of the seamless steel pipe for line pipe according to this embodiment contains the following elements:

C: 0.02 to 0.10%

Carbon (C) improves the strength of steel. However, if C is contained excessively, the toughness of circumferential weld zone of line pipe decreases. Therefore, the C content is 0.02 to 0.10%. The lower limit of C content is preferably 0.04%, and the upper limit of C content is preferably 0.08%.

Si: at most 0.5%

Silicon (Si) deoxidizes steel. However, if Si is contained excessively, the toughness of steel decreases. Therefore, the Si content is at most 0.5%. If the Si content is at least 0.05%, the above-described effect is achieved effectively. The upper limit of Si content is preferably 0.25%.

Mn: 0.5 to 2.0%

Manganese (Mn) enhances the hardenability of steel, and improves the strength of steel. However, if Mn is contained excessively, Mn segregates in steel, and resultantly the toughness of a heat affected zone formed by circumferential welding and the toughness of a base material decrease. Therefore, the Mn content is 0.5 to 2.0%. The Mn content is preferably 1.0 to 1.8%, further preferably 1.3 to 1.8%.

P: at most 0.03%

Phosphorous (P) is an impurity. P decreases the toughness of steel. Therefore, the P content is preferably as low as possible. The P content is at most 0.03%. The P content is preferably at most 0.015%.

S: at most 0.005%

Sulfur (S) is an impurity. S combines with Mn to form coarse MnS, and decreases the toughness and sour resistance of steel. Therefore, the S content is preferably as low as possible. The S content is at most 0.005%. The S content is preferably at most 0.003%, further preferably at most 0.002%.

Ca: at most 0.005%

Calcium (Ca) combines with S in steel to form CaS. The formation of CaS suppresses the production of MnS. That is, Ca suppresses the production of MnS and improves the toughness and resistance to hydrogen induced cracking of steel. Hereunder, the resistance to hydrogen induced cracking is referred to as the "HIC resistance". Any small amount of Ca content can provide the above-described effects. However, if Ca is contained excessively, the cleanliness of steel decreases, and the toughness and HIC resistance thereof decreases. Therefore, the Ca content is at most 0.005%. If the Ca content is at least 0.0005%, the above-described effects can be achieved remarkably. The Ca content is preferably 0.0005 to 0.003%.

Al: 0.01 to 0.1%

The content of aluminum (Al) in the present invention represents the content of acid-soluble Al (what is called Sol.Al). In this embodiment, Al combines with N and forms fine nitrides to improve the toughness of steel. If the Al content is less than 0.01%, the Al nitrides are not refined and dispersed sufficiently. On the other hand, if the Al content exceeds 0.1%, the Al nitrides coarsen, so that the toughness of steel decreases. Therefore, the Al content is 0.01 to 0.1%.

Preferably, the Al content is 0.02 to 0.1%. Considering the combination with Ti and Nb, the Al content is further preferably 0.02 to 0.06%.

N: at most 0.007%

Nitrogen (N) is an impurity. N that has formed a solid solution decreases the toughness of steel. N further coarsens carbo-nitrides, thereby decreasing the toughness of steel. Therefore, the N content is at most 0.007%. Preferably, the N content is at most 0.005%.

The chemical composition of the seamless steel pipe for line pipe according to this embodiment further contains one or more selected from a group consisting of Ti, V and Nb. That is, at least one of Ti, V and Nb is contained. The content of each of Ti, V and Nb are as follows:

Ti: at most 0.008%

Titanium (Ti) combines with N in the steel to form TiN, thereby suppressing the decrease in toughness of steel caused by N forming a solid solution. Further, fine TiN is dispersedly precipitated, thereby further improving the toughness of steel. However, if the Ti content is too high, TiN is coarsened, or coarse TiC is formed, so that the toughness of steel decreases. That is, to refine and disperse TiN, the Ti content is restricted. For the above-described reason, the Ti content is at most 0.008%. The Ti content is preferably at most 0.005%, further preferably at most 0.003%, and still further preferably at most 0.002%. Any small amount of Ti content causes fine TiN to be dispersedly precipitated.

V: less than 0.06%

Vanadium (V) combines with C and N in the steel to form fine carbo-nitrides, thereby improving the toughness of steel. Further, fine V carbo-nitrides improve the strength of steel by means of dispersion strengthening. However, if V is contained excessively, V carbo-nitrides coarsen, so that the toughness of steel decreases. Therefore, the V content is less than 0.06%. The V content is preferably at most 0.05%, further preferably 0.03%. Any small amount of V content causes fine V carbo-nitrides to be dispersedly precipitated.

Nb: at most 0.05%

Niobium (Nb) combines with C and N in the steel to form fine Nb carbo-nitrides, thereby improving the toughness of steel. Further, fine Nb carbo-nitrides improve the strength of steel by means of dispersion strengthening. However, if Nb is contained excessively, Nb carbo-nitrides coarsen, so that the toughness of steel decreases. Therefore, the Nb content is at most 0.05%. Preferably, the Nb content is at most 0.03%. Any small amount of Nb content causes fine Nb carbo-nitrides to be dispersedly precipitated.

The balance of the chemical composition of the seamless steel pipe for line pipe according to this embodiment is iron (Fe) and impurities. The impurities referred to herein are elements that mixedly enter from ore and scrap used as raw materials for steel, the environment of the manufacturing process, and the like.

The chemical composition of the seamless steel pipe for line pipe according to this embodiment may further include one or more selected from a group consisting of Cu, Cr, Ni and No in place of some of Fe. Any of these elements enhances the hardenability of steel and improves the strength thereof. Hereunder, the content of each of these elements are explained.

Cu: at most 1.0%

Copper (Cu) is an optional element. Cu enhances the hardenability of steel and improves the strength thereof. Any small amount of Cu content can provide the above-described effects. On the other hand, if Cu is contained excessively, the weldability of steel decreases. Further, if Cu is contained excessively, the grain boundary strength at high temperature decreases, thereby decreasing the hot workability of steel. Therefore, the Cu content is at most 1.0%. If the Cu content is at least 0.05%, the above-described effects can be achieved remarkably. Preferably, the Cu content is 0.05 to 0.5%.

Cr: at most 1.0%

Chromium (Cr) is an optional element. Cr enhances the hardenability of steel and improves the strength thereof. Cr further enhances the temper softening resistance of steel. Any small amount of Cr content can provide the above-described effects. On the other hand, if Cr is contained excessively, the weldability of steel decreases, and the toughness of steel also decreases. Therefore, the Cr content is at most 1.0%. If the Cr content is at least 0.02%, the above-described effects can be achieved remarkably.

Ni: 1.0%

Nickel (Ni) is an optional element. Ni enhances the hardenability of steel and improves the strength thereof. Any small amount of Ni content can provide the above-described effects. On the other hand, if Ni is contained excessively, the sulfide stress corrosion cracking resistance decreases. Therefore, the Ni content is at most 1.0%. If the Ni content is at least 0.05%, the above-described effects can be achieved remarkably.

Mo: at most 1.0%

Molybdenum (Mo) is an optional element. Mo enhances the hardenability of steel and improves the strength thereof. Any small amount of Mo content can provide the above-described effects. On the other hand, if Mo is contained excessively, the weldability of steel decreases, and the toughness of steel also decreases. Therefore, the Mo content is at most 1.0%. If the Mo content is at least 0.02%, the above-described effects can be achieved remarkably.

Carbon Equivalent and Formula (2)

For the seamless steel pipe for line pipe according to this embodiment, the carbon equivalent (Ceq) defined by Formula (1) is at least 0.38, and the content of Ti, V and Nb satisfies Formula (2).

$$Ceq=C+Mn/6+(Cr+Mo+V)/5+(Ni+Cu)/15 \quad (1)$$

$$Ti+V+Nb<0.06 \quad (2)$$

where, into each of the symbols of elements in Formulas (1) and (2), the content (mass percent) of each element is substituted. In the case where an element corresponding to the symbol of element in Formulas (1) and (2) is not contained, "0" is substituted into the corresponding symbol of the element in Formulas (1) and (2).

As described above, in the chemical composition of this embodiment, the C content is restricted. This is because C remarkably decreases the toughness of the weld zone formed by circumferential welding. However, if the C content is too low, the strength of steel cannot be obtained. In this embodiment, therefore, the carbon equivalent Ceq defined by Formula (1) is at least 0.38. In this case, even if the C content is low, an excellent strength can be obtained. More specifically, the strength grade of seamless steel pipe can be at least ×65 in accordance with the API standards, that is, the yield stress of seamless steel pipe can be at least 450 MPa.

Further, the above-described chemical composition satisfies Formula (2). If the content of Ti, V and Nb satisfies Formula (2), fine specified carbo-nitrides precipitate in the seamless steel pipe manufactured by the manufacturing method described below. In short, one or more of Ti, V and Nb are necessary for forming the specified carbo-nitrides, but the content thereof is restricted. With Formula (2) satisfied, the size of the specified carbo-nitride may be at most 200 nm, and thereby the toughness of seamless steel pipe is improved.

Size of Carbo-Nitride

For the seamless steel pipe according to this embodiment, as described above, the size of the specified carbo-nitride is at most 200 nm. Hereunder, explanation is given of a fact that the toughness of seamless steel pipe is improved when the size of the specified carbo-nitride is at most 200 nm.

FIG. 1 is a graph showing the relationship between the size of specified carbo-nitride and the toughness for the seamless steel pipe having the above-described chemical composition. FIG. 1 was determined by the method described below.

A plurality of seamless steel pipes each having the above-described chemical composition were manufactured. The seamless steel pipes were manufactured under different manufacturing conditions. From the central portion of the wall thickness of the manufactured seamless steel pipe, a V-notch specimen conforming to JIS Z2242 was sampled perpendicularly to the longitudinal direction (in the T direction) of the seamless steel pipe. The V-notch specimen was of a square rod shape having a transverse cross section of 10 mm×10 mm. Also, the depth of the V notch was 2 mm.

The Charpy impact test conforming to JIS Z2242 was conducted at various temperatures by using the V-notch specimens to determine the fracture appearance transition temperature (50% FATT) of each seamless steel pipe. The 50% FATT denotes a temperature at which the percent ductile fracture is 50% on the fracture surface of specimen.

The size of specified carbo-nitride of each seamless steel pipe was determined by the method described below. The extraction replica method was used to sample an extraction replica film from the central portion of the wall thickness of each seamless steel pipe. The extraction replica film was of a disc shape having a diameter of 3 mm. From each of the top portion and the bottom portion of each seamless steel pipe, one extraction replica film was sampled. That is, two extraction replica films were sampled from each seamless steel pipe. On each of the extraction replica films, a transmission electron microscope was used to observe four places (four fields of view) of arbitrary zones of 10 $\mu m^2$ at ×30,000 magnification. That is, for one seamless steel pipe, eight zones were observed.

Figure 2:
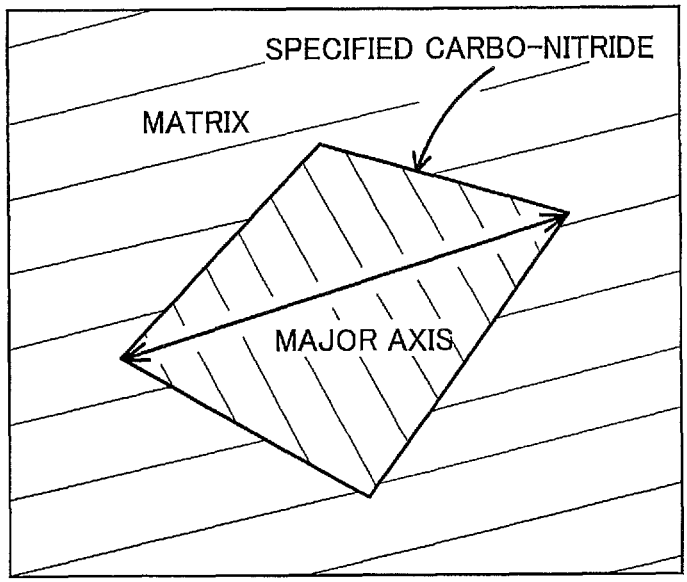
FIG. 2 is a schematic view for explaining a method for measuring the size of carbo-nitride.

In each zone, based on the electron beam diffraction pattern, carbo-nitrides were identified from precipitates. Further, based on the point analysis using an energy dispersive X-ray spectroscope (EDS), the chemical compositions of carbo-nitrides were analyzed, and thereby the specified carbo-nitrides were identified. Ten larger carbo-nitrides were selected from the identified carbo-nitrides, and the major axes (nm) of the selected carbo-nitrides were measured. At this time, as shown in FIG. 2, the maximum of the straight lines connecting two different points at the interface between the specified carbo-nitride and matrix was taken as the major axis of specified carbo-nitride. The average value of the measured major axes (the average value of a total of 80 major axes in eight zones) was defined as the "size of specified carbo-nitride".

Referring to FIG. 1, as the size (nm) of specified carbo-nitride decreased, the 50% FATT decreased gradually. When the size of specified carbo-nitride was smaller than 200 nm, as the size of specified carbo-nitride decreased, the 50% FATT decreased significantly. If the size of specified carbo-nitride was at most 200 nm, the 50% FATT was minus 70° C. or lower, so that an excellent toughness could be obtained.

For this reason, for the seamless steel pipe of this embodiment, the size of specified carbo-nitride is at most 200 nm. Thereby, as described above, the toughness of seamless steel pipe is improved. Specifically, the 50% FATT becomes minus 70° C.

To make the size of specified carbo-nitride at most 200 nm, the seamless steel pipe according to this embodiment is manufactured, for example, by the manufacturing method described below.

Manufacturing Method

One example of the manufacturing method for the seamless steel pipe for line pipe according to this embodiment is explained. In this example, a seamless steel pipe produced by hot working is acceleratedly cooled. The acceleratedly cooled seamless steel pipe is quenched and tempered. Hereunder, the manufacturing method for the seamless steel pipe according to this embodiment is described in detail.

Manufacturing System

Figure 3:
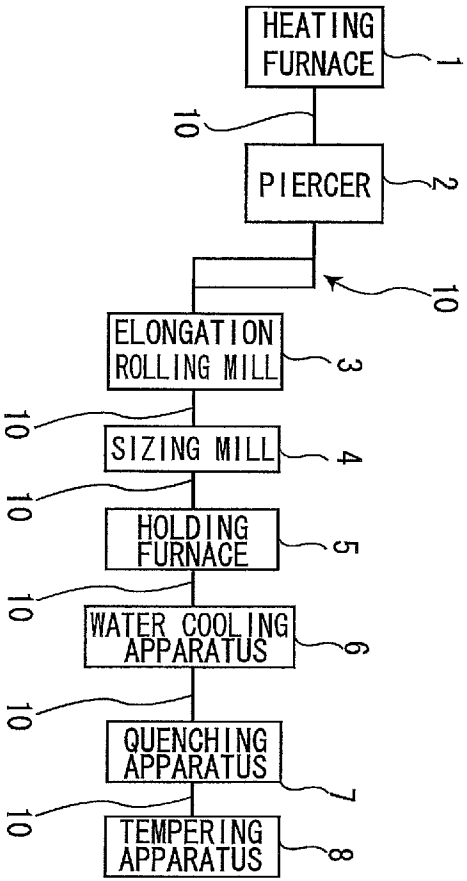
FIG. 3 is a functional block diagram showing a configuration of a manufacturing system for a seamless steel pipe for line pipe according to an embodiment of the present invention.

FIG. 3 is a block diagram showing one example of a manufacturing line for the seamless steel pipe according to this embodiment. Referring to FIG. 3, the manufacturing line includes a heating furnace 1, a piercer 2, a elongation rolling mill 3, a sizing mill 4, a holding furnace 5, a water cooling apparatus 6, a quenching apparatus 7, and a tempering apparatus 8. Between these apparatuses, a plurality of transfer rollers 10 are arranged. In FIG. 3, the quenching apparatus 7 and the tempering apparatus 8 are also included in the manufacturing line. However, the quenching apparatus 7 and the tempering apparatus 8 may be arranged so as to be separate from the manufacturing line. In other words, the quenching apparatus 7 and the tempering apparatus 8 may be arranged off-line.

Manufacturing Flow

Figure 4:
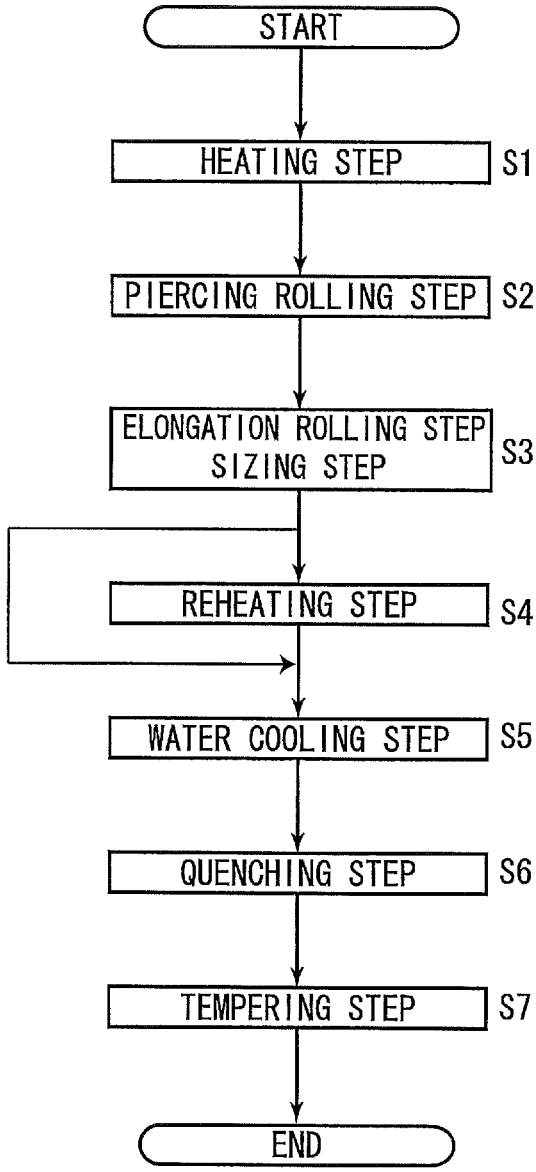
FIG. 4 is a flowchart showing a manufacturing process for a seamless steel pipe for line pipe according to an embodiment of the present invention.
Figure 5:
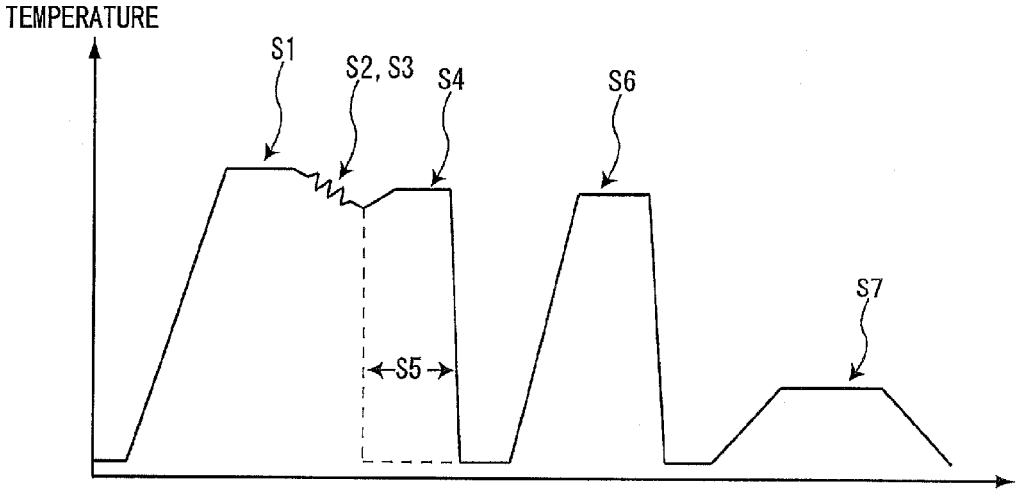
FIG. 5 is a schematic diagram showing the temperature of a billet, material pipe, and seamless steel pipe in the steps shown in FIG. 4.

FIG. 4 is a flowchart showing a manufacturing process for the seamless steel pipe according to this embodiment, and FIG. 5 is a diagram showing a change of surface temperature with respect to time of rolled stocks (steel material, hollow shell, and seamless steel pipe) during manufacture.

Referring to FIGS. 4 and 5, in the manufacturing method for the seamless steel pipe for line pipe according to this embodiment, first, a steel material is heated in the heating furnace 1 (S1). The steel material is, for example, a round billet. The steel material may be produced by using a continuous casting apparatus such as a round CC, or also may be produced by forging or blooming an ingot or a slab. In this example, the explanation is continued assuming that the steel material is a round billet.

The heated round billet is hot worked to form a seamless steel pipe (S2 and S3). Specifically, the round billet is piercing-rolled by the piercing machine 2 to form a hollow shell (S2). Further, the hollow shell is rolled by the elongation rolling mill 3 and the sizing mill 4 to form a seamless steel pipe (S3). The seamless steel pipe produced by hot working is heated to a predetermined temperature by the holding furnace 5 as necessary (S4). Successively, the seamless steel pipe is water cooled by the water cooling apparatus 6 (accelerated cooling: S5). The water-cooled seamless steel pipe is quenched by the quenching apparatus 7 (S6), and is tempered by the tempering apparatus 8 (S7). Hereunder, each of these steps is explained in more detail.

Heating Step (S1)

First, a round billet is heated in the heating furnace 1. The preferable heating temperature is 1100° C. to 1300° C. If the round billet is heated at a temperature in this temperature range, carbo-nitrides in the steel dissolve. In the case where the round billet is produced from a slab or an ingot by hot forging or blooming, at least the heating temperature of the slab and ingot may be 1100 to 1300° C., and the heating temperature of the round billet need not necessarily be 1100 to 1300° C. The heating furnace 1 is, for example, a well-known walking beam furnace or rotary furnace.

Piercing Step (S2)

The round billet is taken out of the heating furnace. The heated round billet is piercing-rolled by the piercing machine 2. The piercer 2 has a well-known configuration. Specifically, the piercer 2 is provided with a pair of inclined rolls and a plug. The plug is arranged between the inclined rolls. The preferable piercer 2 is a cross-type piercer. This is because piercing can be performed at a high pipe expansion rate.

Rolling Step (S3)

Next, the hollow shell is rolled. Specifically, the hollow shell is elongated and rolled by the elongation rolling mill 3. The elongation rolling mill 3 includes a plurality of roll stands arranged in series. The elongation rolling mill 3 is, for example, a mandrel mill. Successively, the elongated and rolled hollow shell is sized by the sizing mill 4 to produce a seamless steel pipe. The sizing mill 4 includes a plurality of roll stands arranged in series. The sizing mill 4 is, for example, a sizer or a stretch reducer.

The surface temperature of the hollow shell rolled by the rearmost roll stand of the roll stands of the sizing mill 4 is defined as a "finishing temperature". The finishing temperature is measured, for example, by a temperature sensor arranged on the outlet side of the rearmost roll stand of the sizing mill 4. The finishing temperature is preferably 900° C. to 1100° C., further preferably 950° C. to 1100° C. If the finishing temperature is at least 950° C., almost all of the carbo-nitrides in the hollow shell form a solid solution. On the other hand, if the finishing temperature exceeds 1100° C., the crystal grains coarsen. To obtain the above-described preferable finishing temperature, a soaking pit may be provided between the elongation rolling mill 3 and the sizing mill 4 to soak the hollow shell elongated and rolled by the elongation rolling mill 3.

Reheating Step (S4)

A reheating step (S4) is carried out as necessary. In short, the reheating step need not be carried out. In the case where the reheating step is not carried out, in FIG. 4, the process proceeds from step S3 to step S5. Also, in the case where the reheating step is not carried out, in FIG. 3, the holding furnace 5 is not provided.

Specifically, in the case where the finishing temperature is lower than 900° C., the reheating step is carried out. The produced seamless steel pipe is charged into the holding furnace 5 and is heated. The preferable heating temperature in the holding furnace 5 is 900° C. to 1100° C. The preferable soaking time is at most 30 minutes. This is because too long soaking time may precipitate and coarsen the carbo-nitrides.

Accelerated Cooling Step (S5)

The seamless steel pipe produced in step S3 or the seamless steel pipe reheated in step S4 is acceleratedly cooled. Specifically, the seamless steel pipe is water cooled by the water cooling apparatus 6. The temperature (surface temperature) of the seamless steel pipe just before being water cooled is at least the $A_{r3}$ point, preferably at least 900° C. The $A_{r3}$ point of the above-described chemical composition is at most 750° C. In the case where the temperature of the seamless steel pipe before being acceleratedly cooled is lower than the $A_{r3}$ point, the seamless steel pipe is reheated by using the above-described holding furnace 5 or an induction heating apparatus to make the temperature of seamless steel pipe at least the $A_{r3}$ point.

The cooling rate of the seamless steel pipe at the time of accelerated cooling is at least 100° C./min, and the cooling stop temperature is at most the $A_{r1}$ point. The $A_{r1}$ point of the above-described chemical composition is at most 550° C. The preferable cooling stop temperature is at most 450° C. Thereby, the specified carbo-nitrides can be restrained from precipitating in the seamless steel pipe at this time. Also, the parent phase structure is martensitized or bainitized, being densified. Specifically, a martensite lath or a bainite lath is produced in the matrix micro-structure of seamless steel pipe.

The configuration of the water cooling apparatus 6 is, for example, as described below. The water cooling apparatus 6 includes a plurality of rollers, a laminar water flow device, and a jet water flow device. The rollers are arranged in two rows. The seamless steel pipe is placed between the rollers arranged in two rows. At this time, each of the rollers arranged in two rows comes into contact with the lower portion of the outer surface of seamless steel pipe. When the rollers are rotated, the seamless steel pipe rotates around the axis thereof. The laminar water flow device is disposed above the rollers, and pours water over the seamless steel pipe from the upside. At this time, the water poured over the seamless steel pipe forms a laminar water flow. The jet water flow device is arranged near the end of seamless steel pipe on the rollers. The jet water flow device injects jet water flow toward the interior of the steel pipe from the end of seamless steel pipe. The laminar water flow device and the jet water flow device are used to cool the outer and inner surfaces of seamless steel pipe at the same time. Such a configuration of the water cooling apparatus 6 is especially suitable for accelerated cooling of a thick-wall seamless steel pipe having a wall thickness of at least 35 mm.

The water cooling apparatus 6 may be an apparatus other than the above-described apparatus including the rollers, the laminar water flow device, and the jet water flow device. For example, the water cooling apparatus 6 may be a water tank. In this case, the seamless steel pipe produced in step S3 is immersed in the water tank and is cooled. Also, the water cooling apparatus 6 may include the laminar water flow device only. That is to say, the type of the water cooling apparatus 6 is not restricted.

Quenching Step (S6)

The seamless steel pipe having been water cooled by the water cooling apparatus 6 is reheat quenched. Specifically, the seamless steel pipe is heated by the quenching apparatus 7 (reheating step). By this heating, the matrix micro-structure of seamless steel pipe is austenitized. Then, the heated seamless steel pipe is quenched by cooling (cooling step). Thereby, fine specified carbo-nitrides are dispersedly precipitated in the dense metal micro-structure of seamless steel pipe, which consists mainly of martensite or bainite, formed by the accelerated cooling in step S5.

In the reheating step in step S6, the temperature of seamless steel pipe is at least the $A_{c3}$ point by the heating using the quenching apparatus 7. The $A_{c3}$ point of the above-described chemical composition is 800 to 900° C. At this time, the heating rate during the time when the temperature (surface temperature) of seamless steel pipe is 600° C. to 900° C. is at least 3° C./min. The heating rate referred to herein is determined by the method described below. The heating rate during the time when the temperature of seamless steel pipe is 600° C. to 900° C. is measured at intervals of one minute. The average value of the measured heating rates is defined as a "heating rate" in the range of 600° C. to 900° C.

If the heating rate during the time when the temperature of seamless steel pipe is 600° C. to 900° C. is at least 3° C./min, specified carbo-nitrides each having a size of at most 200 nm are dispersedly precipitated. The heating rate at the time when the temperature of seamless steel pipe is 600° C. to 900° C. is preferably at least 5° C./min, further preferably at least 10° C./min.

In the cooling step in step S6, the seamless steel pipe heated to at least the $A_{c3}$ point is quenched by accelerated cooling. As described above, the quenching start temperature is at least the $A_{c3}$ point. Further, the cooling rate during the time when the temperature of seamless steel pipe is 800° C. to 500° C. is at least 5° C./sec. Thereby, a uniform quenching structure can be obtained. The cooling stop temperature is at most the $A_{r1}$ point.

Tempering Step (S7)

The quenched steel pipe is tempered. The tempering temperature is at most the $A_{c1}$ point, and is controlled based on the desired dynamic characteristics. The $A_{c1}$ point of the seamless steel pipe having the above-described chemical composition is 680 to 740° C. By tempering, the strength grade of the seamless steel pipe of the present invention can be at least ×65 according to the API standards, that is, the yield stress of the seamless steel pipe can be at least 450 MPa.

By the above-described manufacturing process, the size of specified carbo-nitride in the seamless steel pipe can be at most 200 nm. In particular, even for the seamless steel pipe having a wall thickness of at least 35 mm, the size of specified carbo-nitride can be at most 200 nm by the above-described manufacturing method. Therefore, the above-described manufacturing method is especially suitable for the seamless steel pipe having a wall thickness of at least 35 mm, and can be applied to the seamless steel pipe having a wall thickness of at least 40 mm. That is, with the above-described manufacturing method, a seamless steel pipe having a wall thickness of at least 35 mm and at least 40 mm, in which the size of carbo-nitride in the steel is at most 200 nm, can be manufactured.

EXAMPLES

A plurality of seamless steel pipes for line pipe having various chemical compositions were manufactured, and the strength, toughness, and sour resistance of each of the seamless steel pipes were examined. Further, circumferential welding was performed on each of the seamless steel pipes, and the toughness of the circumferential weld zone was examined.

Examination Method

A plurality of steels having the chemical compositions given in Table 1 were melted, and a plurality of round billets were produced by the continuous casting process.

TABLE 1

| Steel | Chemical compositions (Unit: mass %, Balance: Fe and impurities) | | | | | | | | | | | |
|---|---|---|---|---|---|---|---|---|---|---|---|---|
| No. | C | Si | Mn | P | S | Cu | Cr | Ni | Mo | Ti | V | Nb |
| A | 0.062 | 0.24 | 1.51 | 0.014 | 0.0011 | — | 0.24 | 0.19 | 0.16 | 0.003 | 0.015 | 0.026 |
| B | 0.064 | 0.25 | 1.52 | 0.010 | 0.0010 | 0.20 | 0.27 | 0.20 | 0.23 | 0.004 | — | 0.027 |
| C | 0.052 | 0.08 | 1.48 | 0.009 | 0.0011 | 0.19 | 0.25 | 0.18 | 0.24 | — | 0.053 | — |
| D | 0.059 | 0.09 | 1.48 | 0.012 | 0.0010 | 0.21 | 0.31 | 0.31 | 0.24 | 0.003 | 0.052 | — |
| E | 0.052 | 0.23 | 1.53 | 0.014 | 0.0007 | — | 0.26 | — | 0.25 | — | — | 0.026 |
| F | 0.062 | 0.23 | 1.71 | 0.008 | 0.0010 | — | 0.26 | — | 0.20 | 0.007 | 0.030 | — |
| G | 0.063 | 0.23 | 1.30 | 0.008 | 0.0011 | — | 0.25 | — | 0.20 | 0.006 | 0.050 | — |
| H | 0.041 | 0.08 | 1.48 | 0.007 | 0.0011 | 0.21 | 0.29 | 0.28 | 0.24 | — | 0.050 | — |
| I | 0.070 | 0.10 | 1.49 | 0.011 | 0.0010 | 0.15 | 0.20 | 0.14 | 0.20 | 0.003 | — | 0.035 |
| J | 0.069 | 0.24 | 1.52 | 0.011 | 0.0009 | 0.21 | 0.27 | 0.20 | 0.27 | 0.006 | — | 0.026 |
| K | 0.111 | 0.26 | 1.35 | 0.012 | 0.0009 | 0.14 | 0.20 | 0.15 | 0.20 | 0.002 | — | 0.037 |
| L | 0.059 | 0.13 | 1.51 | 0.010 | 0.0006 | — | 0.30 | 0.21 | 0.25 | 0.007 | 0.050 | 0.021 |
| M | 0.072 | 0.11 | 1.85 | 0.011 | 0.0007 | — | — | — | — | 0.007 | 0.030 | 0.021 |

| Steel | Chemical compositions (Unit: mass %, Balance: Fe and impurities) | | | | | |
|---|---|---|---|---|---|---|
| No. | Sol. Al | Ca | N | Ceq | Ti + Nb + V | |
| A | 0.032 | 0.0021 | 0.0041 | 0.409 | 0.044 | Example embodiment of the present invention |
| B | 0.029 | 0.0021 | 0.0047 | 0.444 | 0.031 | Example embodiment of the present invention |
| C | 0.035 | 0.0018 | 0.0040 | 0.432 | 0.053 | Example embodiment of the present invention |
| D | 0.040 | 0.0021 | 0.0035 | 0.461 | 0.055 | Example embodiment of the present invention |
| E | 0.031 | 0.0016 | 0.0048 | 0.409 | 0.026 | Example embodiment of the present invention |
| F | 0.025 | 0.0031 | 0.0049 | 0.449 | 0.037 | Example embodiment of the present invention |
| G | 0.024 | 0.0029 | 0.0045 | 0.380 | 0.056 | Example embodiment of the present invention |
| H | 0.021 | 0.0009 | 0.0037 | 0.436 | 0.050 | Example embodiment of the present invention |
| I | 0.021 | 0.0012 | 0.0044 | 0.418 | 0.038 | Example embodiment of the present invention |
| J | 0.033 | 0.0024 | 0.0042 | 0.458 | 0.032 | Example embodiment of the present invention |
| K | 0.039 | 0.0020 | 0.0040 | 0.435 | 0.039 | Comparative example |
| L | 0.030 | 0.0022 | 0.0050 | 0.445 | 0.078 | Comparative example |
| M | 0.030 | 0.0022 | 0.0050 | 0.386 | 0.058 | Example embodiment of the present invention |

Referring to Table 1, the chemical compositions of steels A to J and M were within the range of the present invention. Also, the carbon equivalents of steels A to J and M were at least 0.38. Further, steels A to J and M satisfied Formula (2).

On the other hand, the C content of steel K exceeded the upper limit of C content defined in the present invention. Although the chemical composition of steel L was in the range of the present invention, steel L did not satisfy Formula (2).

The produced round billets were heated to 1100 to 1300° C. in the heating furnace. Successively, the round billets were piercing-rolled by the piercer to form hollow shells. Then, the hollow shells were elongated and rolled by the mandrel mill. Then, the hollow shells were sized by the sizer to produce a plurality of seamless steel pipes. The seamless steel pipes each had a wall thickness of 40 mm.

Table 2 gives manufacturing conditions of manufacturing processes after sizing.

After sizing, some of the seamless steel pipes were heated in the holding furnace under the "Soaking condition in holding furnace" in Table 2. Subsequently, the seamless steel pipes of test Nos. 1 to 22 were acceleratedly cooled by water cooling. The "Accelerated cooling start temperature" in Table 2 indicates a temperature (surface temperature) of seamless steel pipe after sizing or heating in the holding furnace and just before the execution of accelerated cooling. The cooling rate at the time of accelerated cooling was as given in the "Accelerated cooling rate" in Table 2, and the cooling stop temperature for all of the seamless steel pipes were at most 450° C.

After accelerated cooling, the seamless steel pipes were reheated and quenched. In reheating, the heating rate at 600° C. to 900° C. of each seamless steel pipe was as given in the "Reheating heating rate" in Table 2. Further, the seamless steel pipes were soaked under the "Soaking condition" in column "Quenching" in Table 2. After soaking, the seamless steel pipes were quenched by cooling. The cooling rate was as

TABLE 2

| Test No. | Steel | Soaking condition in holding furnace | Accelerated cooling start temperature | Accelerated cooling rate | Quenching: Reheating heating rate | Quenching: Soaking condition | Quenching: Cooling rate | Quenching: Cooling stop temperature |
|---|---|---|---|---|---|---|---|---|
| 1 | A | 950° C._10 min | 930° C. | 300° C./min | 6° C./min | 950° C. 10 min | 300° C./min | At most 100° C. |
| 2 | A | — | 930° C. | 300° C./min | 5° C./min | 950° C. 10 min | 300° C./min | At most 100° C. |
| 3 | B | 920° C._10 min | 900° C. | 300° C./min | 6° C./min | 950° C. 10 min | 300° C./min | At most 100° C. |
| 4 | B | — | 900° C. | 300° C./min | 5° C./min | 950° C. 10 min | 300° C./min | At most 100° C. |
| 5 | C | 950° C._10 min | 900° C. | 300° C./min | 6.5° C./min | 950° C. 10 min | 300° C./min | At most 100° C. |
| 6 | C | — | 900° C. | 300° C./min | 5° C./min | 950° C. 10 min | 300° C./min | At most 100° C. |
| 7 | C | 920° C._10 min | 900° C. | 300° C./min | 5° C./min | 910° C. 10 min | 300° C./min | At most 100° C. |
| 8 | C | 950° C._10 min | 900° C. | 300° C./min | 10° C./min | 920° C. 5 min | 300° C./min | At most 100° C. |
| 9 | D | 950° C._10 min | 930° C. | 300° C./min | 7° C./min | 950° C. 10 min | 300° C./min | At most 100° C. |
| 10 | D | 920° C._10 min | 900° C. | 300° C./min | 5° C./min | 910° C. 10 min | 300° C./min | At most 100° C. |
| 11 | D | 920° C._10 min | 900° C. | 300° C./min | 3.5° C./min | 920° C. 10 min | 300° C./min | At most 100° C. |
| 12 | E | 950° C._10 min | 930° C. | 300° C./min | 6.5° C./min | 950° C. 10 min | 300° C./min | At most 100° C. |
| 13 | F | — | 930° C. | 300° C./min | 5° C./min | 950° C. 10 min | 300° C./min | At most 100° C. |
| 14 | G | 950° C._10 min | 930° C. | 300° C./min | 5° C./min | 950° C. 10 min | 300° C./min | At most 100° C. |
| 15 | H | 950° C._10 min | 930° C. | 300° C./min | 5° C./min | 950° C. 10 min | 300° C./min | At most 100° C. |
| 16 | I | 950° C._10 min | 930° C. | 300° C./min | 6° C./min | 950° C. 10 min | 300° C./min | At most 100° C. |
| 17 | J | 950° C._10 min | 930° C. | 300° C./min | 5° C./min | 950° C. 10 min | 300° C./min | At most 100° C. |
| 18 | K | 950° C._10 min | 930° C. | 300° C./min | 5° C./min | 950° C. 10 min | 300° C./min | At most 100° C. |
| 19 | L | 950° C._10 min | 930° C. | 300° C./min | 5° C./min | 950° C. 10 min | 300° C./min | At most 100° C. |
| 20 | J | 950° C._10 min | 900° C. | 300° C./min | 2°C./min | 950° C. 10 min | 300° C./min | At most 100° C. |
| 21 | J | — | 900° C. | 5°C./min | 5° C./min | 950° C. 10 min | 300° C./min | At most 100° C. |
| 22 | M | 950° C._10 min | 930° C. | 300° C./min | 12° C./min | 950° C. 10 min | 300° C./min | At most 100° C. |

| Test No. | Steel | Tempering temperature | Size of specified carbonitride (nm) | YS (MPa) | TS (MPa) | 50% FATT (° C.) | Sour resistance |
|---|---|---|---|---|---|---|---|
| 1 | A | 600° C. | 150 | 495 | 568 | −98 | Not ruptured |
| 2 | A | 600° C. | 160 | 501 | 572 | −94 | Not ruptured |
| 3 | B | 600° C. | 160 | 537 | 612 | −86 | Not ruptured |
| 4 | B | 600° C. | 170 | 534 | 607 | −87 | Not ruptured |
| 5 | C | 600° C. | 170 | 539 | 595 | −96 | Not ruptured |
| 6 | C | 600° C. | 190 | 514 | 578 | −90 | Not ruptured |
| 7 | C | 600° C. | 170 | 550 | 597 | −94 | Not ruptured |
| 8 | C | 600° C. | 150 | 518 | 582 | −106 | Not ruptured |
| 9 | D | 600° C. | 160 | 598 | 648 | −80 | Not ruptured |
| 10 | D | 650° C. | 170 | 551 | 603 | −90 | Not ruptured |
| 11 | D | 650° C. | 190 | 559 | 629 | −77 | Not ruptured |
| 12 | E | 600° C. | 100 | 515 | 590 | −100 | Not ruptured |
| 13 | F | 600° C. | 190 | 549 | 621 | −75 | Not ruptured |
| 14 | G | 600° C. | 160 | 488 | 565 | −85 | Not ruptured |
| 15 | H | 600° C. | 180 | 493 | 562 | −82 | Not ruptured |
| 16 | I | 600° C. | 140 | 530 | 588 | −92 | Not ruptured |
| 17 | J | 600° C. | 130 | 533 | 585 | −96 | Not ruptured |
| 18 | K | 600° C. | 130 | 532 | 650 | −79 | — |
| 19 | L | 600° C. | 400 | 566 | 631 | −45 | — |
| 20 | J | 600° C. | 320 | 534 | 583 | −32 | — |
| 21 | J | 600° C. | 300 | 516 | 578 | −60 | — |
| 22 | M | 600° C. | 110 | 468 | 525 | −110 | Not ruptured |

given in the "Cooling rate" in Table 2, and the cooling was stopped at the "Cooling stop temperature" given in Table 2.

After quenching, the seamless steel pipes were tempered. The tempering temperature was as given in Table 2, being at most the $A_{c1}$ point, for all of the seamless steel pipes.

Measurement of Size of Specified Carbo-Nitride

On the tempered seamless steel pipes of test Nos. 1 to 21, the size of specified carbo-nitride was examined by the above-described measurement method.

The measured size of specified carbo-nitride is given in Table 2. Referring to Table 2, for the seamless steel pipes of test Nos. 1 to 18 and 22, the size of specified carbo-nitride was at most 200 nm. On the other hand, since steel L of test No. 19 did not satisfy Formula (2), the size of specified carbo-nitride of test No. 19 exceeded 200 nm. For the seamless steel pipe of test No. 20, the heating rate during the time when the temperature of seamless steel pipe at the quenching time was 600 to 900° C. was lower than 3° C./min. Therefore, the size of specified carbo-nitride of test No. 20 exceeded 200 nm. For the seamless steel pipe of test No. 21, the cooling rate at the accelerated cooling time after sizing was lower than 100° C./min. Therefore, the size of specified carbo-nitride of test No. 21 exceeded 200 nm.

Examination of Yield Stress

The yield strengths of the tempered seamless steel pipes of test Nos. 1 to 22 were examined. Specifically, from each of the seamless steel pipes, a No. 12 specimen (width: 25 mm, gage length: 200 mm) specified in JIS Z2201 was sampled along the longitudinal direction (L direction) of each seamless steel pipe. The sampled specimen was used to carry out the tensile test conforming to JIS Z2241 in the atmosphere at ordinary temperature (25° C.) to determine yield stress (YS) and tensile strength (TS). The yield stress was determined by the 0.5% total elongation method. The obtained yield stresses (MPa) and tensile strengths (MPa) are given in Table 2. The "YS" in Table 2 indicates the yield stress obtained by the specimen of each test number, and the "TS" indicates the tensile stress.

Examination of Toughness

The toughnesses of the tempered seamless steel pipes of test Nos. 1 to 22 were examined. Specifically, from the central portion of the wall thickness of each of the seamless steel pipes, a V-notch specimen conforming to JIS Z2242 was sampled perpendicularly to the longitudinal direction of seamless steel pipe (in the T direction). The V-notch specimen was of a square rod shape having a transverse cross section of 10 mm×10 mm. Also, the depth of the V notch was 2 mm. This V-notch specimen was used to carry out the Charpy impact test conforming to JIS Z2242 at various temperatures to determine the fracture appearance transition temperature (50% FATT) of seamless steel pipe. Table 2 gives the 50% FATT obtained by the specimen of each test number.

Examination of Sour Resistance

The sour resistances of the tempered seamless steel pipes of test Nos. 1 to 17 and 22 were examined. Specifically, from the central portion of the wall thickness of each of the seamless steel pipes, a round bar specimen extending in the roll direction of seamless steel pipe was sampled. The outside diameter of the parallel part of round bar specimen was 6.35 mm, and the length of the parallel part was 25.4 mm. According to the NACE (National Association of Corrosion Engineers) TM0177A method, the sour resistance of each round bar specimen was examined by a constant load test. The test bath was an aqueous solution of 5% common salt+0.5% acetic acid at ordinary temperature in which hydrogen sulfide gas of 1 atm was saturated. Ninety percent of the actual yield stress was applied to each round bar specimen, and the specimen was immersed in the test bath for 720 hours.

After 720 hours has elapsed after immersion, it was checked whether or not each round bar specimen had ruptured. If the round bar specimen was not ruptured, it was judged that the seamless steel pipe of that test number is excellent in sour resistance. If the round bar specimen was ruptured, it was judged that the seamless steel pipe of that test number is poor in sour resistance. Table 2 gives the evaluation of sour resistance. The "Not ruptured" in Table 2 indicates that the round bar specimen is not ruptured in the above-described test. The symbol "-" in Table 2 indicates that the test was not carried out.

Examination of Toughness of Circumferential Weld Zone

Figure 6:
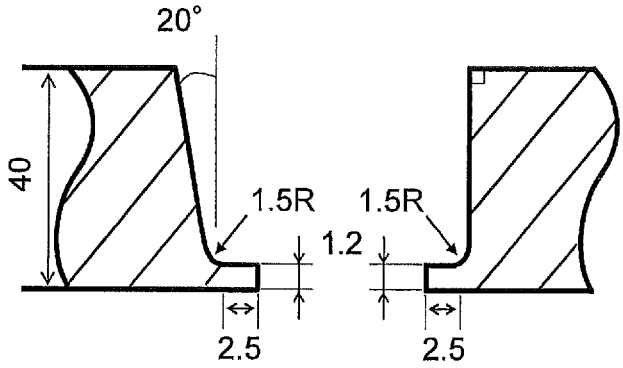
FIG. 6 is a sectional view showing a groove shape of a seamless steel pipe at the time when a circumferential weldability test is carried out in examples.

On the tempered seamless steel pipes of test Nos. 3, 5 and 18, a circumferential welding test was carried out. Specifically, each seamless steel pipe of the concerned test number was cut in the central portion in the longitudinal direction. The cut portion was subjected to edge preparation to take a longitudinally sectioned shape shown in FIG. 6. Under the welding conditions given in Table 3, the cut portions of the two cut-off seamless steel pipes were circumferentially welded to each other. As shown in Table 3, circumferential welding was performed under two heat input conditions (heat input condition 1 and heat input condition 2) for each test number.

TABLE 3

| | |
|---|---|
| Welding method | GTAW (gas tungsten arc welding) |
| Wire used | AWS A5.28 ER90S-G |
| Preheating | Not done |
| Interlayer temperature | 100~150° C. |
| Shielding gas | 100% Ar |
| Number of welding passes | 98~161 |
| Heat input | Heat input condition 1: 6 kJ/cm<br>Heat input condition 2: 12 kJ/cm |

From each of the circumferentially welded seamless steel pipes, a Charpy V-notch specimen including a weld zone (including weld metal, heat affected zone, and base material) was sampled in the longitudinal direction of seamless steel pipe (L direction). Specifically, from each of the seamless steel pipes, three specimens, in which the V notch is arranged on a fusion line (FL) the toughness of which is liable to deteriorate of the heat affected zone (HAZ), were sampled, and further three specimens, in which the V notch is arranged in the two-phase zone HAZ (V. HAZ), were sampled. That is, six specimens were sampled for each heat input condition of each test number.

The sampled specimens was used to carry out the Charpy test conforming to JIS Z2242 at a test temperature of minus 40° C. to determine absorbed energy. The lowest value of three absorbed energy values obtained for each heat input condition of each test number was defined as the absorbed energy under each heat input condition of each test number. The absorbed energy obtained by the test is shown in Table 4.

TABLE 4

| | | Heat input 6 kJ/cm | | Heat input 12 kJ/cm | |
|---|---|---|---|---|---|
| Test No. | Steel | Notch located on FL | Notch located in V.HAZ | Notch located on FL | Notch located in V.HAZ |
| 3 | B | 210 J | 270 J | 310 J | 290 J |
| 5 | C | 220 J | 290 J | 300 J | 260 J |
| 18 | K | 30 J | 90 J | 20 J | 250 J |

Examination Results

Referring to Table 2, for the seamless steel pipes of test Nos. 1 to 17 and 22, the chemical composition was within the range of the present invention, the carbon equivalent was at least 0.38, and the chemical composition satisfied Formula (2). Further, the size of specified carbo-nitride was at most 200 nm. Therefore, the yield stress of each of the seamless steel pipes of test Nos. 1 to 17 and 22 was at least 450 MPa, corresponding to the strength grade of at least ×65 according to the API standards. The 50% FATT of each of the seamless steel pipes of test Nos. 1 to 17 and 22 was minus 70° C. or lower, that is, the seamless steel pipes of test Nos. 1 to 17 were excellent in toughness. Also, the seamless steel pipes of test Nos. 1 to 17 and 22 were excellent in sour resistance. Further, the absorbed energy at minus 40° C. obtained by the circumferential weldability test exceeded 200 J, the toughness of the weld zone being also high.

On the other hand, the C content of test No. 18 exceeded the upper limit of C content defined in the present invention. Therefore, as shown in Table 4, in some cases, the absorbed energy obtained by the circumferential weldability test was lower than 200 J, the toughness of the weld zone being low.

The seamless steel pipe of test No. 19 did not satisfy Formula (2). Therefore, the size of specified carbo-nitride exceeded 200 nm, and the 50% FATT was higher than minus 70° C. That is, the toughness of the seamless steel pipe of test No. 19 was low.

For the seamless steel pipe of test No. 20, the chemical composition was within the range of the present invention, the carbon equivalent was at least 0.38, and the chemical composition satisfied Formula (2). However, at the quenching time, the heating rate during the time when the temperature of seamless steel pipe was 600 to 900° C. was low, so that the size of specified carbo-nitride exceeded 200 nm. Therefore, the 50% FATT of the seamless steel pipe of test No. 20 was higher than minus 70° C., the toughness being low.

For the seamless steel pipe of test No. 21, the chemical composition was within the range of the present invention, the carbon equivalent was at least 0.38, and the chemical composition satisfied Formula (2). However, the cooling rate of accelerated cooling after sizing was low, so that the size of specified carbo-nitride exceeded 200 nm. Therefore, the 50% FATT of the seamless steel pipe of test No. 21 was higher than minus 70° C., the toughness being low.

The above is a description of one embodiment of the present invention. The above-described embodiment is merely an illustration for carrying out the present invention. Therefore, the present invention is not limited to the above-described embodiment, and the present invention can be applied by appropriately changing or modifying the above-described embodiment without departing from the spirit and scope of the present invention.

The invention claimed is:

1. A seamless steel pipe for line pipe having a chemical composition comprising, by mass percent, C: 0.02 to 0.10%, Si: at most 0.5%, Mn: 0.5 to 2.0%, Al: 0.01 to 0.1%, P: at most 0.03%, S: at most 0.005%, Ca: at most 0.005%, and N: at most 0.007%, and further comprising at least one selected from a group consisting of Ti: at most 0.008%, V: less than 0.06%, and Nb: at most 0.05%, the balance being Fe and impurities, the carbon equivalent Ceq defined by Formula (1) being at least 0.38, content of Ti, V and Nb satisfying Formula (2), and the size of carbo-nitride comprising at least one of Ti, V, Nb and Al being at most 200 nm:

$$Ceq=C+Mn/6+(Cr+Mo+V)/5+(Ni+Cu)/15 \quad (1)$$

$$Ti+V+Nb<0.069 \quad (2)$$

where, into each of the symbols of elements in Formulas (1) and (2), the content (mass percent) of each element is substituted, and in the case where an element corresponding to the symbol of element in Formulas (1) and (2) is not contained, "0" is substituted into the corresponding symbol of the element in Formulas (1) and (2).

2. The seamless steel pipe according to claim 1, wherein the chemical composition comprises at least one selected from a group consisting of Cu: at most 1.0%, Cr: at most 1.0%, Ni: at most 1.0%, and Mo: at most 1.0% in place of some of Fe.

3. The seamless steel pipe according to claim 1, which is manufactured by being hot worked, thereafter being accelerated cooled at a cooling rate of at least 100° C/min, and further being quenched and tempered.

4. The seamless steel pipe according to claim 2, which is manufactured by being hot worked, thereafter being accelerated cooled at a cooling rate of at least 100° C/min, and further being quenched and tempered.

5. The seamless steel pipe according to claim 3, wherein, after being acceleratedly cooled, the seamless steel pipe is heated to at least the $A_{c3}$ point and quenched, and in heating of a quenching step, the heating rate at the time when the temperature of the seamless steel pipe is 600 to 900° C. is at least 3° C/min.

6. The seamless steel pipe according to claim 4, wherein, after being acceleratedly cooled, the seamless steel pipe is heated to at least the $A_{c3}$ point and quenched, and in heating of a quenching step, the heating rate at the time when the temperature of the seamless steel pipe is 600 to 900° C. is at least 3° C/min.

7. A method for manufacturing a seamless steel pipe for line pipe, comprising the steps of:

heating a steel material having a chemical composition comprising, by mass percent, C: 0.02 to 0.10%, Si: at most 0.5%, Mn: 0.5 to 2.0%, Al: 0.01 to 0.1%, P: at most 0.03%, S: at most 0.005%, Ca: at most 0.005%, and N: at most 0.007%, and further comprising at least one selected from a group consisting of Ti: at most 0.008%, V: less than 0.06%, and Nb: at most 0.05%, the balance being Fe and impurities, the carbon equivalent Ceq defined by Formula (1) being at least 0.38, and content Ti, V and Nb satisfying Formula (2);

producing a hollow shell by piercing the heated steel material;

producing a seamless steel pipe by rolling the hollow shell;

acceleratedly cooling the rolled seamless steel pipe to at most the Ar1 point at a cooling rate of at least 100° C/min;

quenching the acceleratedly-cooled seamless steel pipe after temperature of the seamless steel pipe reaches at least the $A_{c3}$ point by heating the seamless steel pipe at a heating rate of at least 3° C/min at the time when temperature of the seamless steel pipe is 600 to 900° C.; and tempering the quenched seamless steel pipe at a temperature of at most the $A_{c1}$ point:

$$Ceq=C+Mn/6+(Cr+Mo+V)/5+(Ni+Cu)/15 \quad (1)$$

$$Ti+V+Nb<0.06 \quad (2)$$

where, into each of the symbols of elements in Formulas (1) and (2), the content (mass percent) of each element is substituted, and in the case where an element corresponding to the symbol of element in Formulas (1) and (2) is not contained, "0" is substituted into the corresponding symbol of the element in Formulas (1) and (2).

8. The method for manufacturing a seamless steel pipe according to claim 7, wherein the chemical composition of the steel material comprises at least one selected from a group consisting of Cu: at most 1.0%, Cr: at most 1.0%, Ni: at most 1.0%, and Mo: at most 1.0% in place of some of Fe.

* * * * *